US006702331B2

(12) United States Patent
Derraugh et al.

(10) Patent No.: US 6,702,331 B2
(45) Date of Patent: Mar. 9, 2004

(54) FOAM BOOK WITH CONCERTINA BINDING

(76) Inventors: William Derraugh, 35 Rogues Ridge Rd., Weston, CT (US) 06883; Michael John Morris, 7 Shorehaven Rd., Norwalk, CT (US) 06855

( * ) Notice: Subject to any disclaimer, the term of this patent is extended or adjusted under 35 U.S.C. 154(b) by 0 days.

(21) Appl. No.: 09/997,189

(22) Filed: Nov. 20, 2001

(65) Prior Publication Data

US 2003/0132628 A1 Jul. 17, 2003

(51) Int. Cl.[7] ..... B42D 1/00

(52) U.S. Cl. ..... 281/38; 281/15.1; 281/21.1; 281/29; 283/63.1; 446/147

(58) Field of Search ..... 281/15.1, 21.1, 281/23, 29, 36, 37, 38; 283/34, 42, 63.1; 446/147

(56) References Cited

U.S. PATENT DOCUMENTS

| | | | | | |
|---|---|---|---|---|---|
| 2,915,842 | A | * | 12/1959 | Finnell | 40/530 |
| 2,949,306 | A | * | 8/1960 | Gitelson et al. | 273/240 |
| 5,096,204 | A | * | 3/1992 | Lippman | 273/285 |
| 5,725,196 | A | * | 3/1998 | Scheel | 281/15.1 |
| 6,070,909 | A | * | 6/2000 | Kaufman | 281/29 |
| 6,133,892 | A | * | 10/2000 | Borgwardt | 345/1.3 |
| 6,224,106 | B1 | * | 5/2001 | Murphy | 281/15.1 |
| 6,257,622 | B1 | * | 7/2001 | Peker | 281/16 |
| 6,364,360 | B1 | * | 4/2002 | Kaufman | 281/15.1 |
| 2001/0041114 | A1 | * | 11/2001 | Melcher | 412/1 |

FOREIGN PATENT DOCUMENTS

| | | |
|---|---|---|
| GB | 2252655 | * 12/1992 |
| JP | 408323050 | * 12/1996 |

* cited by examiner

*Primary Examiner*—Monica S. Carter
(74) *Attorney, Agent, or Firm*—Tope-McKay & Associates

(57) ABSTRACT

A concertina-bound foam-based book is presented, comprising a plurality of foam pages, each having a first edge and a second edge. The first edge is opposite the second edge on each page, and the pages are bound along their first edges and second edges in a concertina fashion with a water-resistant binding means. When fully opened, the concertina-bound foam-based book opens as a string of pages and such that when closed, the pages of the concertina-bound foam-based book form a stack of pages. A variety of specific binding means and binding materials may be used in conjunction with the present invention. A method for making the concertina-bound foam-based book of the present invention is also provided.

12 Claims, 4 Drawing Sheets

FOAM BOOK WITH CONCERTINA BINDING

BACKGROUND OF THE INVENTION

1. Field of the Invention

The present invention relates to bookbinding, and more specifically to a foam book which is bound in a concertina-type fashion.

2. Description of the Prior Art

Bookbinding has been a useful art for many centuries. After the advent of printing machines, book binding a widespread activity. There are numerous references both in the literature and in the patent archives detailing various bookbinding techniques. In a broad sense, binding techniques have been applied not only to create books, but also to retain loose-leaf papers and other materials. Numerous examples of these retainers exist in the patent literature.

Improvements in printing technology have allowed written pages to be adapted for many purposes, and have also allowed a greater variety of materials to be used for printing. A number of book binding techniques and materials have been provided in the patent literature, examples of which include U.S. Pat. Nos. 6,189,932; 6,186,690; 5,219,437; 5,536,044; 5,499,847; and 6,257,622.

One drawback of typical paper books as well as many of the techniques used for binding them is that they often use water soluble components, which dissolve or disintegrate after a short period of immersion in water and which are difficult to clean. Children's books have traditionally been made of large sheets of paper with hard or semi-hard paper-based covers. In addition to being water soluble, these books also possess sharp edges which, combined with the books' hardness can make them unsuitable and potentially dangerous for small children. Younger children tend to learn about their world through their tactile senses, so it would be desirable to provide soft non-paper books with which they can physically play and gain tactile experience. In addition, it would be desirable to provide books with binding mechanisms made from a material that is water resistant, so a child can read and play with them while in the bath or by the poolside and so that they can be cleaned easily. One of the materials particularly suitable for this purpose is foam.

In addition to the above characteristics, it would also be desirable to provide a binding mechanism that is not only water resistant, but that also allows the book to be opened such that long images may be displayed across a plurality of pages and in different directions.

SUMMARY OF THE INVENTION

The present invention comprises a concertina-bound foam-based book that includes a plurality of foam pages. Each page includes a first edge and a second edge with the first edge opposite the second edge on each page. Each of the plurality of foam pages is bound along its first and second edges in a concertina fashion. The binding means is a water-resistant binding material such as foam, cloth, plastic, or nylon. When fully opened, the concertina-bound foam-based book opens as a string of pages and such that when closed, the pages of the concertina-bound foam-based book form a stack of pages. The binding means can cover at least a portion of each page of each pair of pages.

In another embodiment, each page may be formed of two pieces of foam pieced together in a sandwich-like manner, and where the binding means is fixedly attached between the two pieces of foam of each adjoining page in order to connect the adjoining pages. The binding material may be formed continuously across the plurality of pages that comprise the book.

In yet another embodiment, each page includes two faces, and at each page, a portion of the binding means is attached with the edge of one of the pieces of foam comprising each page such that the binding means forms a hinged connection where the edge of the piece transitions to the face of the page (typically a corner).

In a still further embodiment, each page includes two opposite faces, and the binding means on one side of a page is on the opposite face from the binding means on the other side of the page.

In another embodiment, each page is formed of three foam pieces sandwiched together with the two outermost foam pieces of each positioned to overlap and to be connected with the innermost piece of another page so that the pages are bound together.

The present invention also includes a method for making a concertina-bound foam-based book. In a first embodiment, the method comprises the steps of: providing a plurality of foam pages, each with a first and second edge with the first and second edges opposite each other on each page; and binding the foam pages along their edges in a concertina fashion with with a water-resistant binding means. The binding is performed such that when the book is fully opened, the concertina-bound foam-based book opens as a string of pages and such that when closed, the pages of the concertina-bound foam-based book form a stack of pages.

In a further embodiment of the method, the pages provided may be comprised of two pieces of foam assembled in a sandwich-like manner. The foam pages may be bound by a binding means fixedly attached between the two pieces of foam of each adjoining page in order to connect the adjoining pages.

In a still further embodiment, in the binding step, a portion of the binding means may be attached with the edge of one of the pieces of foam comprising each page such that the binding means forms a hinged connection where the edge of the piece transitions to the face of the page (generally a corner).

In yet another embodiment of the method of the present invention, in the binding step, the binding means is applied such that it the binding means on one side of a page is on the opposite face from the binding means on the other side of the page.

In a yet further embodiment of the method of the present invention, the pages provided and bound may be formed of three foam pieces pieced together in a sandwich-like manner. As such, the pieces include an innermost foam piece and two outermost foam pieces sandwiching the innermost foam piece. Each of the outermost foam pieces of each page are positioned such that they overlap and are fixedly connected with a portion of the innermost foam piece of another page, thus binding the pages together.

BRIEF DESCRIPTION OF THE DRAWINGS

The novel features of the present invention are set forth in the appended claims. These features, aspects, and advantages of the present invention may be best understood in conjunction with the detailed description, with reference to the accompanying drawings.

FIG. 1(*b*) is a perspective view of a general embodiment of the foam book with concertina binding of the present invention, showing the book in a closed position;

FIG. 1(*c*) is a is a perspective view of a general embodiment of the foam book with concertina binding of the present invention, showing the book in a partially open position;

FIG. 2(*b*) is an edge-view of the foam book with concertina binding depicted in FIG. 2(*a*) detailing the binding technique;

FIG. 2(*c*) is an edge-view of the foam book with concertina binding depicted in FIG. 2(*a*) detailing a modified binding technique;

FIG. 3(*b*) is an edge-view of the foam book with concertina binding depicted in FIG. 3(*a*) detailing the binding technique;

FIG. 4(*b*) is an edge-view of the foam book with concertina binding depicted in FIG. 3(*a*) detailing the binding technique.

DETAILED DESCRIPTION OF THE PREFERRED EMBODIMENTS

The present invention relates to the field bookbinding. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

Figure 1A:
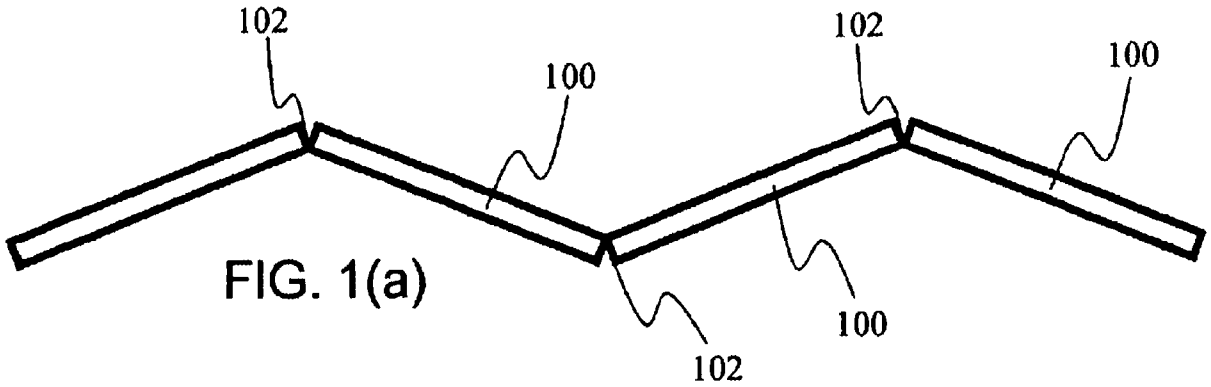
FIG. 1(*a*) is an edge-view of a general embodiment of the foam book with concertina binding of the present invention, showing the book in a partially open position.
Figure 1B:
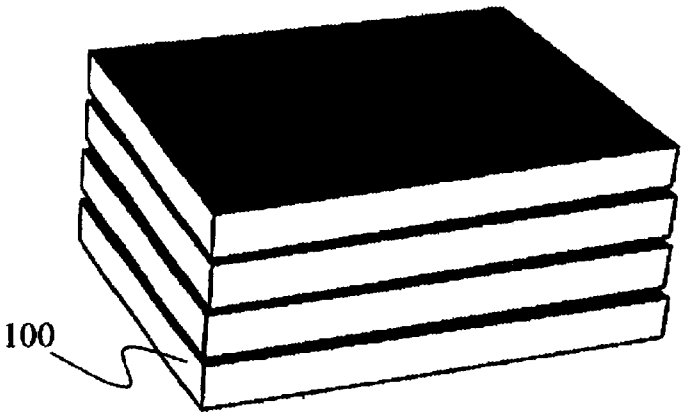
Figure 1C:
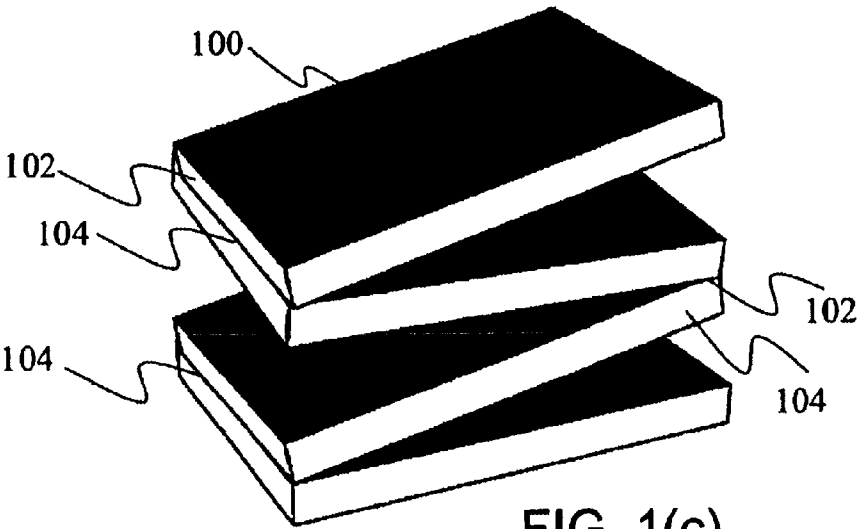

An edge-view of a general embodiment of the foam book with concertina binding of the present invention, showing the book in a partially open position is presented in FIG. 1(*a*). A plurality of pages 100 are hingedly connected by a binding means 102 such that they may open and close in a "concertina" or "accordion" like fashion. The pages used in the present invention are formed of soft, yet rigid foam such as EVA foam. The binding means 102 is of a water-resistant or water-proof foldable material such as cloth, nylon, plastic, foam, or nylon. A principal object of the present invention is to provide a foam book that is waterproof, easily cleanable, and that is soft so that it won't easily harm young children. A perspective view of the general embodiment of the foam book is presented in FIG. 1(*b*), with the pages 100 in a closed position. When folded, the book has the general shape of a stack of pages. Another perspective view of the general embodiment of the foam book of the present invention is shown in FIG. 1(*c*) with the pages 100 in a partially open position. In this view, the general configuration of the binding means 102 can be readily seen. With the exception of the first and last page, all of the pages are hingedly connected at two opposite edges 104, providing the "concertina" folding mechanism.

Many potential binding means could be used to provide the general embodiment of the present invention as shown in FIG. 1(*a*)–FIG. 1(*c*). Following, a description of three preferred binding means is provided.

Figure 2A:
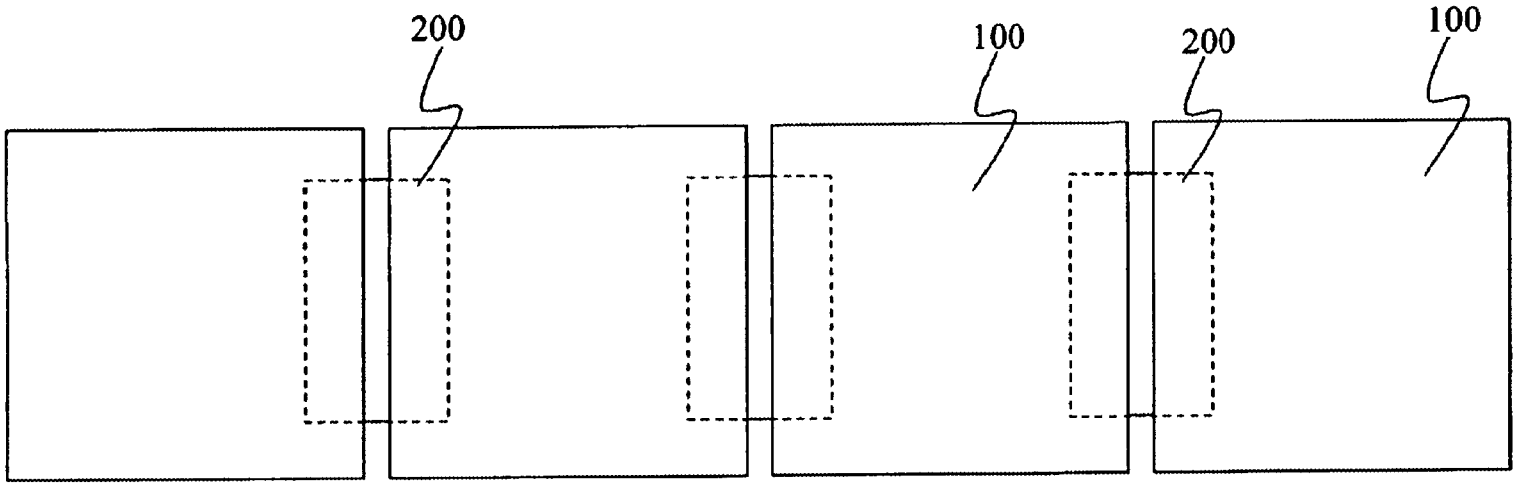
FIG. 2(*a*) is a front-view of a fully opened foam book with concertina binding depicting a first example binding technique where a binder material is layered between two pieces of foam forming each page.
Figure 2B:
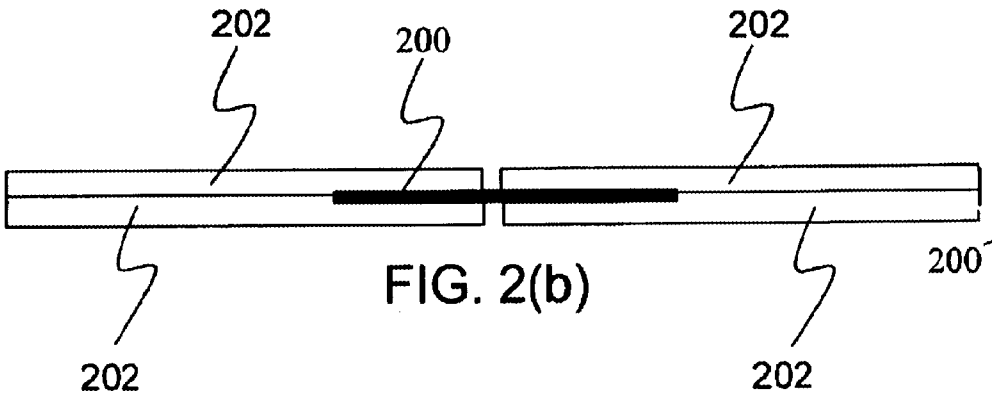
Figure 2C:
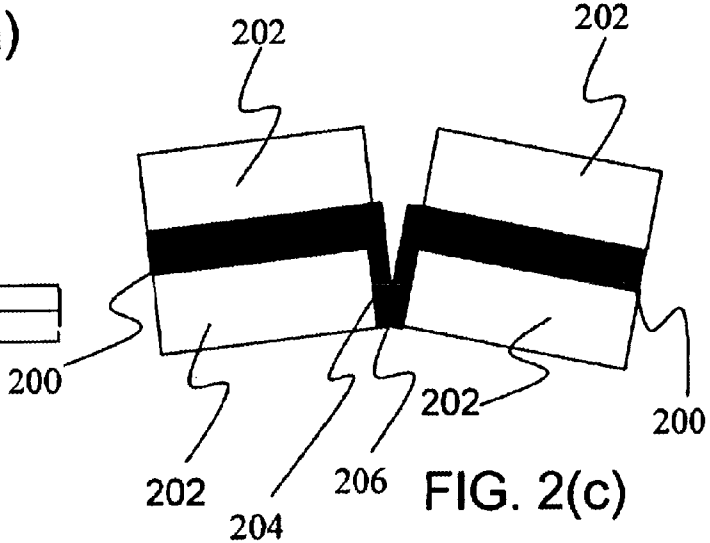

A front-view of a fully opened foam book of the present invention is shown in FIG. 2(*a*). In this embodiment, the binding means 200 is a binder material, preferably cloth, layered between two pieces of foam which form each page 100. In this front-view, the binding means 200 is depicted through the use of dotted lines to indicate that it is sandwiched between the foam pieces, out of sight, except for the portion between the pages.

Greater detail of the book depicted in FIG. 2(*a*) may be seen in the edge-view illustration shown in FIG. 2(*b*). Each foam page is comprised of two foam pieces 202 with the binding means 200 sandwiched therebetween. Although depicted covering only a portion of the area between the pages, it is important to note that is also possible for the binding means 200 to cover the entire area between the pages.

An alternate embodiment of the binding mechanism depicted in FIG. 2(*a*) and FIG. 2(*b*) is depicted in FIG. 2(*c*), where a portion of the binding means 204 is formed along the edge of one of the foam pieces 202 such that a hinge 206 is formed near the surface of the pages. This embodiment has an advantage in that the hinge 206 guides the opening and closing of the pages 200 and allows for more precise opening and closing of the book. In a book incorporating the embodiment of the binding mechanism depicted in FIG. 2(*c*), each subsequent adjacent hinge 206 is positioned on the opposite side of the page to facilitate the "concertina" opening and closing of the book.

Figure 3A:
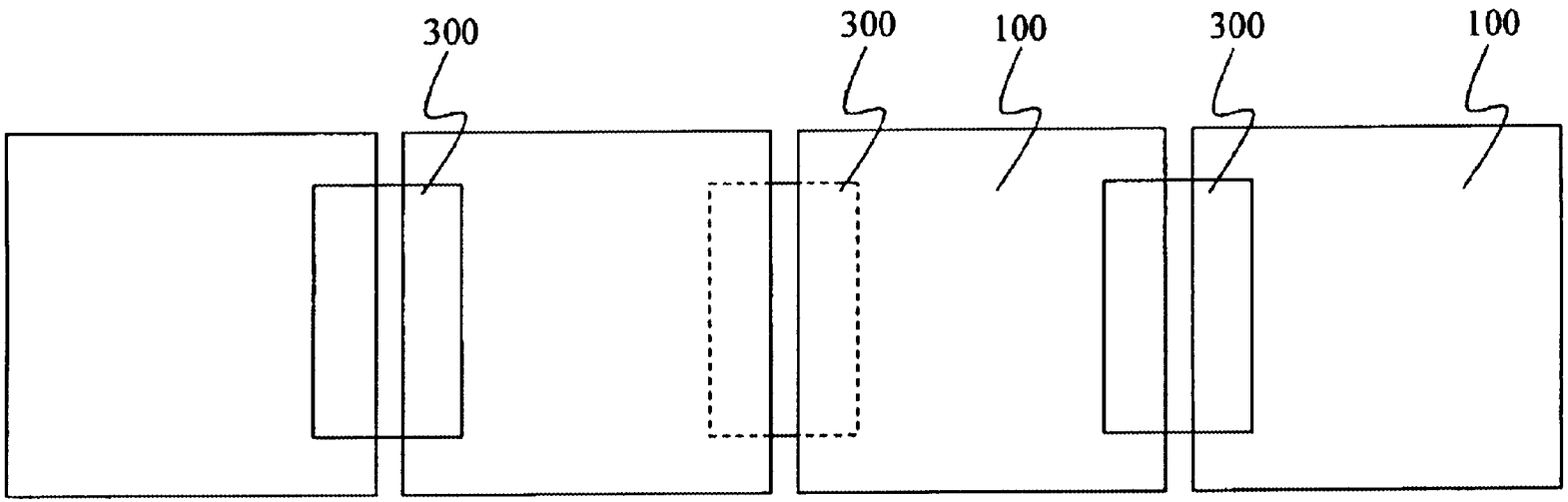
FIG. 3(*a*) is a front-view of a fully opened foam book with concertina binding depicting a second example binding technique where a binder material is layered on alternate sides of the foam pages.
Figure 3B:
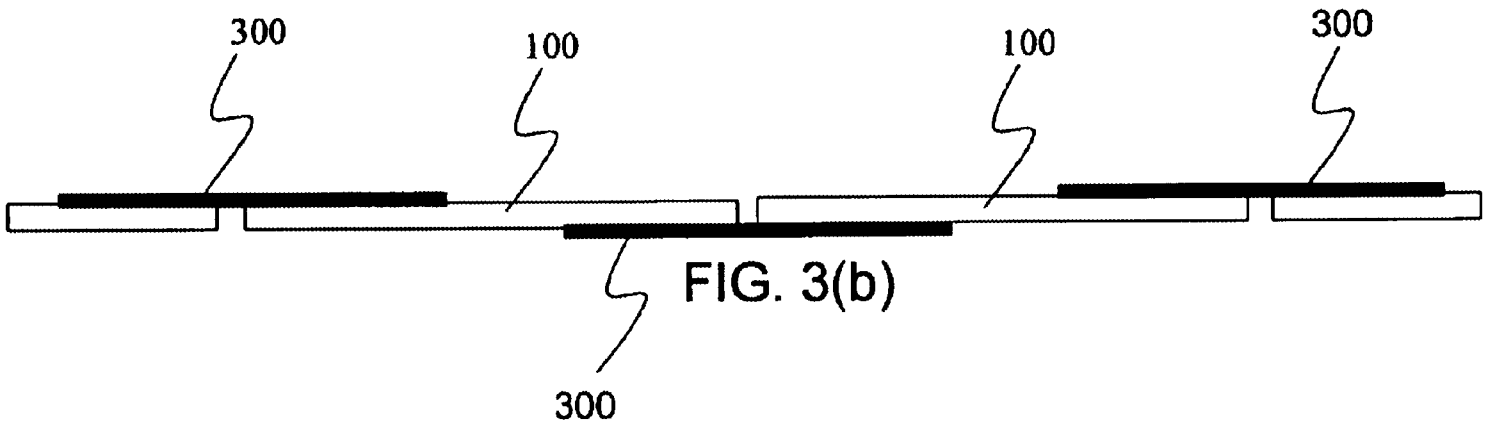

A still further embodiment of the binding mechanism is depicted in FIGS. 3(*a*) and (*b*). In this embodiment, the binding means 300 is simply a strip of material attached on alternating sides of the pages 100 to allow for "concertina" opening and closing. As previously stated, the material is a water-resistant or water-proof material, non-limiting examples of which include foldable materials such as cloth, nylon, plastic, foam, or nylon. Top and edge-views of this embodiment are depicted in FIGS. 3(*a*) and 3(*b*), respectively.

Figure 4A:
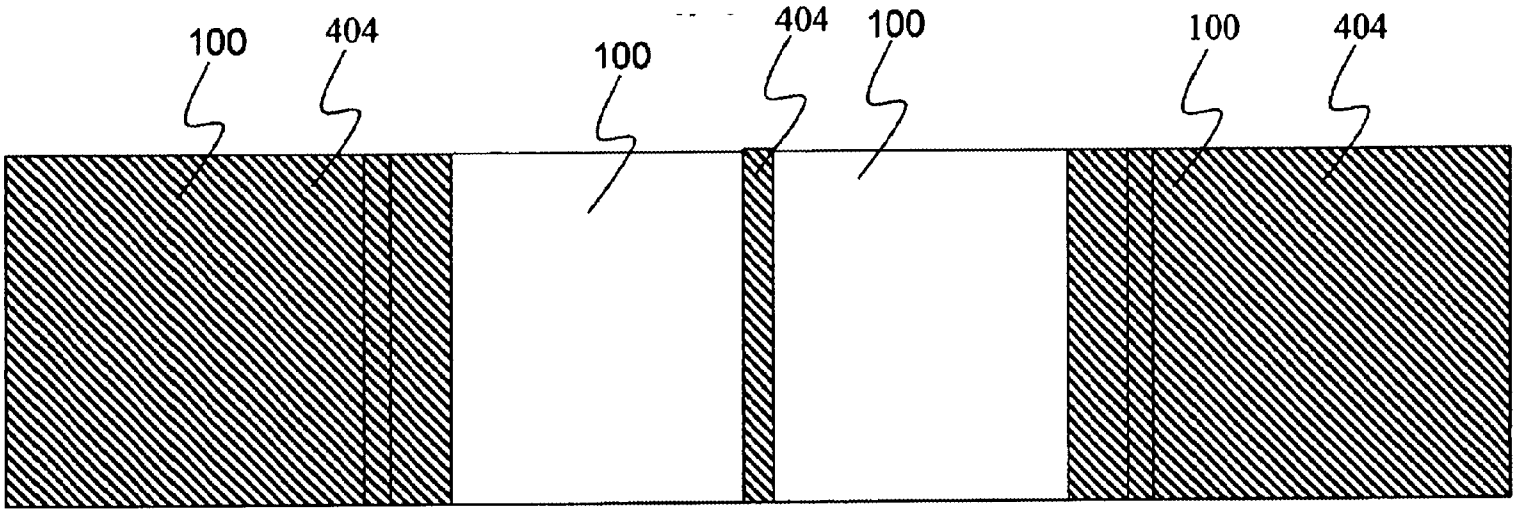
FIG. 4(*a*) is a front-view of a fully opened foam book with concertina binding depicting a third example binding technique where the binder material is a foam layer incorporated into alternate sides of the foam pages.
Figure 4B:
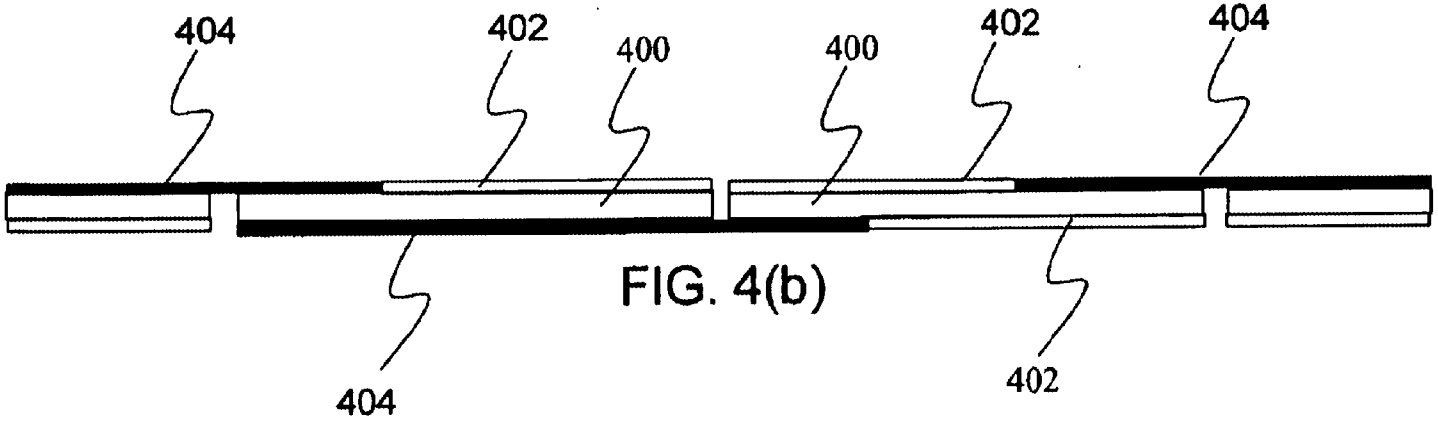

Another embodiment of the binding means incorporated in the present invention is depicted in FIG. 4(*a*) and FIG. 4(*b*), where each of the pages 100 is formed of three foam pieces pieced together in a sandwich-like manner. The pieces include an innermost (or core) piece 400 including an innermost foam piece and two outermost pieces 402. A portion of each outermost piece forms the binding means 404. The binding means may be of any material previously discussed, but is preferably formed of a foam material. In this embodiment, each of the two outermost foam pieces 402 of each page 100 are positioned such that they overlap and are fixedly connected with a portion of the innermost foam piece 400 of another page. In this embodiment, different colors or textures of foam (or other materials) may be used in combination to produce many book combinations that are attractive for young children. In the figures, front and edge views of a fully opened foam book using this binding mechanism are depicted in FIG. 4(*a*) and FIG. 4(*b*), respectively.

The present invention may also be employed as a method for making a concertina-bound foam-based book, with the steps in a general embodiment including providing a plurality of foam pages 100, each having a first edge and a second edge, wherein the first edge is opposite the second edge on the page. Next, in a binding step, the plurality of foam pages are bound along their first edges and second edges in a concertina fashion such that when the book is fully opened, the concertina-bound foam-based book opens as a string of pages and such that when closed, the pages of the concertina-bound foam-based book form a stack of pages. This embodiment of the method produces the embodiment depicted in FIG. 1(*a*)–FIG. 1(*c*).

Additionally, in order to produce the embodiment depicted in FIGS. 2(*a*) and 2(*b*), the pages provided are each formed of two pieces of foam pieced together in a sandwich-like manner. In the binding step, a binding means is applied such that it is fixedly attached between the two pieces of foam of each adjoining page in order to connect the adjoining pages.

Further, in order to produce the modified embodiment depicted in FIG. 2(*c*), in the binding step, a portion of the binding means is attached with the edge of one of the pieces of foam comprising each page so that the binding means forms a hinged connection where the edge of the piece transitions to the face of the page. Note that this typically occurs at a corner of the edge, assuming that the pages have 90 degree corners. On opposite edges of the page, the hinged connection is formed on the opposite piece of foam.

In an additional embodiment of the method, in the binding step, a binding means is applied such that the binding means on one side of a page is on the opposite face from the binding means on the other side of the page. This embodiment of the method results in the embodiment of the book depicted in FIGS. 3(*a*) and 3(*b*).

Finally, to produce the embodiment of the concertina-bound foam-based book depicted in FIGS. 4(*a*) and (*b*), the pages provided and bound are formed of three foam pieces that are assembled in a sandwich-like fashion. The foam pieces include an innermost foam piece and two outermost foam pieces that sandwich the innermost foam pice. The two outermost foam pieces of each page are positioned so that they overlap and are fixedly connected with a portion of the innermost foam piece of another page, thus binding the pages together.

In any of the previously mentioned binding methods, excepting the last, the binding means may be applied continuously across the plurality of pages that comprise the book in order to bind the pages together, rather than just to a portion.

The binding means applied in the binding step of the method may be any water-resistant or water-proof foldable material such as cloth, nylon, plastic, foam, or nylon.

What is claimed is:

1. A concertina-bound foam-based book comprising a plurality of foam pages, each having a first edge and a second edge with the first edge opposite the second edge on each page, and with the plurality of foam pages bound along their first edges and second edges in a concertina fashion with a water-resistant binding means such that when fully opened, the concertina-bound foam-based book opens as a string of pages and such that when closed, the pages of the concertina-bound foam-based book form a stack of pages, wherein each page is formed of two pieces of foam pieced together in a sandwich-like manner, and where the binding means is fixedly attached between the two pieces of foam of each adjoining page in order to connect the adjoining pages.

2. A concertina-bound foam-based book as set forth in claim 1, wherein the binding means is formed continuously across the plurality of pages that comprise the book.

3. A concertina-bound foam-based book as set forth in claim 1, wherein each page includes two faces, and wherein at each page, a portion of the binding means is attached with the edge of one of the pieces of foam comprising each page such that the binding means forms a hinged connection where the edge of the piece transitions to the face of the page.

4. A concertina-bound foam-based book comprising a plurality of foam pages, each having a first edge and a second edge with the first edge opposite the second edge on each page, and with the plurality of foam pages bound along their first edges and second edges in a concertina fashion with a water-resistant binding means such that when fully opened, the concertina-bound foam-based book opens as a string of pages and such that when closed, the pages of the concertina-bound foam-based book form a stack of pages, wherein each page includes two opposite faces, and wherein the binding means on one side of a page is on the opposite face from the binding means on the other side of the page.

5. A concertina-bound foam-based book comprising a plurality of foam pages, each having a first edge and a second edge with the first edge opposite the second edge on each page, and with the plurality of foam pages bound along their first edges and second edges in a concertina fashion with a water-resistant binding means such that when fully opened, the concertina-bound foam-based book opens as a string of pages and such that when closed, the pages of the concertina-bound foam-based book form a stack of pages, wherein each page is formed of three foam pieces pieced together in a sandwich-like manner including an innermost foam piece and two outermost foam pieces sandwiching the innermost foam piece, with each of the two outermost foam pieces of each page positioned such that they overlap and are fixedly connected with a portion of the innermost foam piece of another page, thus binding the pages together.

6. A concertina-bound foam-based book as set forth in claim 5, wherein the alternating ones of the outermost foam pieces join alternating pairs of innermost foam pieces by overlapping with at least a portion of each of the pieces that comprise each of the alternating pairs of innermost foam pieces, whereby the alternating pairs of innermost foam pieces are joined on alternating sides by alternating ones of the outermost foam pieces, with the outermost foam pieces acting as a binding means to bind the pages together.

7. A concertina-bound foam-based book as set forth in claim 6, wherein a portion of each innermost foam piece that is not overlapped by an outermost foam piece is covered by an outermost filler block.

8. A concertina-bound foam-based book as set forth in claim 6, wherein outermost foam piece overlaps a whole innermost foam piece and a portion of another innermost foam piece, and where a portion of the innermost foam piece that is not overlapped with an outermost foam piece is covered by an outermost filler block.

9. A method for making a concertina-bound foam-based book, the method comprising the steps of:

providing a plurality of foam pages, each having a first edge and a second edge with the first edge opposite the second edge on each page; and binding the plurality of foam pages along their first edges and second edges in a concertina fashion with a water-resistant binding means such that when the book is fully opened, the concertina-bound foam-based book opens as a string of pages and such that when closed, the pages of the concertina-bound foam-based book form a stack of pages; and wherein the pages provided in step (a) are formed of two pieces of foam pieced together in a sandwich-like manner, and where the plurality of foam pages are bound in step (b) by a binding means fixedly attached between the two pieces of foam of each adjoining page in order to connect the adjoining pages.

10. A method for making a concertina-bound foam-based book as set forth in claim 9, wherein each page provided in step (a) includes two faces, and wherein in the binding step (b), a portion of the binding means is attached with the edge of one of the pieces of foam comprising each page such that the binding means forms a hinged connection where the edge of the piece transitions to the face of the page.

11. A method for making a concertina-bound foam-based book, the method comprising the steps of:

providing a plurality of foam pages, each having a first edge and a second edge with the first edge opposite the second edge on each page; and binding the plurality of foam pages along their first edges and second edges in a concertina fashion with a water-resistant binding means such that when the book is fully opened, the concertina-bound foam-based book opens as a string of pages and such that when closed, the pages of the concertina-bound foam-based book form a stack of pages; and wherein each page provided in step (a) includes two opposite faces, and wherein in the binding step (b), a binding means is applied such that the binding means on one side of a page is on the opposite face from the binding means on the other side of the page.

12. A method for making a concertina-bound foam-based book, the method comprising the steps of:

providing a plurality of foam pages, each having a first edge and a second edge with the first edge opposite the second edge on each page; and binding the plurality of foam pages along their first edges and second edges in a concertina fashion with a water-resistant binding means such that when the book is fully opened, the concertina-bound foam-based book opens as a string of pages and such that when closed, the pages of the concertina-bound foam based book form a stack of pages; and wherein each page provided in step (a) and bound in step (b) are formed of three foam pieces pieced together in a sandwich-like manner including an innermost foam piece and two outermost foam pieces sandwiching the innermost foam piece, with each of the two outermost foam pieces of each page positioned such that they overlap and are fixedly connected with a portion of the innermost foam piece of another page, thus binding the pages together.

* * * * *